US005206667A

United States Patent [19]

Yano

[11] Patent Number: 5,206,667

[45] Date of Patent: Apr. 27, 1993

[54] FLEMING-TYPE INK JET HEAD

[75] Inventor: Akio Yano, Kawasaki, Japan

[73] Assignee: Fujitsu Limited, Japan

[21] Appl. No.: 755,961

[22] Filed: Sep. 6, 1991

[30] Foreign Application Priority Data

| | | | |
|---|---|---|---|
| Sep. 7, 1990 | [JP] | Japan | 2-238646 |
| Sep. 7, 1990 | [JP] | Japan | 2-238647 |
| Oct. 12, 1990 | [JP] | Japan | 2-273872 |
| Oct. 12, 1990 | [JP] | Japan | 2-273873 |
| Oct. 19, 1990 | [JP] | Japan | 2-281675 |

[51] Int. Cl.[5] ..... B41J 2/035

[52] U.S. Cl. ..... 346/140 R

[58] Field of Search ..... 346/140 R

[56] References Cited

FOREIGN PATENT DOCUMENTS

| | | | |
|---|---|---|---|
| 0144977 | 11/1981 | Japan | 346/140 PD |
| 0083459 | 5/1982 | Japan | 346/140 PD |
| 0101452 | 5/1987 | Japan . | |
| 0151345 | 7/1987 | Japan | 346/140 R |
| 0160244 | 7/1987 | Japan . | |
| 0160646 | 6/1989 | Japan . | |

*Primary Examiner*—Benjamin R. Fuller

*Assistant Examiner*—Alrick Bobb

*Attorney, Agent, or Firm*—Nikaido, Marmelstein, Murray & Oram

[57] ABSTRACT

A Fleming-type ink jet head in which a group of electrodes constituting one of two rows of a plurality of pairs of electrodes for causing currents to flow across ink channels are integrally formed for the purpose of improving the accuracy with which the pairs of electrodes are relatively positioned as well as reducing the manufacture cost. The resistance between each of the pairs of electrodes is detected and the width or magnitude of a pulse current caused to flow between the electrodes is controlled based on the data of this detection, thereby preventing a deterioration in printing quality due to the non-uniformity of the resistance. Also, the width or magnitude of current pulse is controlled with respect to the positions of the channels to compensate for the non-uniformity of the magnetic field intensity through the channels stacked between magnets, whereby a deterioration in printing quality due to the non-uniformity of the magnetic field intensity is prevented. A circuit for heating the ink in the channels is provided to prevent a deterioration in printing quality due to a change in the viscosity of the ink.

20 Claims, 10 Drawing Sheets

FLEMING-TYPE INK JET HEAD

BACKGROUND OF THE INVENTION

1. Field of the Invention

This invention relates to an ink-jet head for recording letters or figures on the surface of a recording medium such as a sheet of paper by ejecting thereon small ink droplets and, more particularly, to a Fleming-type head which uses a magnetic and electric crossed-field applied to an ink flow path to motivate the generation of the ink droplets.

2. Description of the Related Art

A Fleming-type ink jet head is well known in which a magnetic and electric fields perpendicular to each other are applied transversely to an electroconductive ink flow passage, and in which a pulse like change is caused in one of the magnetic and electric fields to generate a driving force to eject ink through a nozzle. This type of head applies the driving force in only one direction and therefore has an improved efficiency and is capable of limiting the deterioration in the frequency response in comparison with other types of ink-jet heads (e.g., one based on pressurizing ink by utilizing deformation of a piezoelectric element caused by application of a voltage and a bubble jet type based on pressurizing by locally heating ink to form bubbles).

The Fleming-type ink jet head, however, entails the following problems to be solved.

To maintain the same printing quality as typewriters and dot printers presently put to practical use, it is necessary to arrange 24 or more nozzles of the above-noted ink jet head on a straight line at pitches of, for example, 0.14 mm in the ink-jet head. For this arrangement and for the purpose of ensuring high printing quality and reducing the manufacturing cost, it is important to devise a structural design enabling high-density integration of the nozzles, ink channels and electrodes adjacent to the channels.

(2) In the ink-jet head, a surplus part of the ink to which the force of inertia is applied by an electromagnetic force such as that mentioned above, accumulates at the nozzle end. FIG. 1 schematically shows ink 1 forming a droplet and ink 2 (trickle of ink) accumulating and remaining at the nozzle end. In FIG. 1, reference numerals 3 and 4 designate the ink-jet head and the ink channel, respectively. Some part of ink 2 joins a droplet next ejected through the same nozzle. Consequently, if there is a trickle like ink 2, droplets of ink 1 cannot be formed uniformly in size, resulting in a deterioration in printing quality. To cope with this problem, a wiper for removing such a trickle of ink may be provided. However, the structure of the ink-jet head or of a printer in which the ink-jet head is used is thereby made complicated and the problem of a reduction in the printing speed due to the existence of the step of removing ink with the wiper is particularly serious.

(3) Ordinarily, a common magnet is provided in association with ink channels to apply a magnetic field to the ink channels. The intensity of the magnetic field is smaller the channel is remoter from magnetic poles and closer to the center of the head because of divergence of magnetic flux, and the magnetic shielding effect of the electrodes, and the ink ejecting force is correspondingly reduced. Therefore droplets of ink 1 ejected through the nozzles are not uniform, resulting in a deterioration in printing quality.

(4) Inequality of electric currents flowing across the ink channels results in non-uniformity of the size of droplets of ink 1 and, hence, a deterioration in printing quality. Such inequality of electric currents is due to a change in the conductivity of ink, non-uniformity of the areas of the electrode surfaces facing each other, inequality of the resistances of current supply circuits including the electrodes, and other factors.

The change in the conductivity of ink also relates to variations in ejection frequency with respect to nozzles. That is, in a nozzle of a low ejection frequency, the viscosity of and the resistance of ink are increased as the solvent evaporates during staying in the ink channels. The size of ejected ink droplets is thereby changed.

To cope with this problem, a method of removing residual ink in each channel before the printing operation to supply ink at a constant density has been proposed. However, if this method is used, the structure of the ink-jet head or the printer using the ink-jet head is complicated and the consumption of ink is increased.

SUMMARY OF THE INVENTION

It is therefore an object of the present invention to provide an ink-jet head reduced in cost while improved in printing quality.

Another object of the present invention is to provide an ink-jet head free from occurrence of ink trickling at the nozzle end.

Still another object of the present invention is to provide an ink jet head in which the uniformity of a magnetic field applied to ink channels is improved, and in which a degree of non-uniformity which cannot be eliminated is compensated.

A further object of the present invention is to provide an ink jet head in which the non-uniformity of electric currents flowing across the ink channels or the viscosity of ink is compensated.

To achieve these objects, according to the present invention, there is provided an ink jet head in which a plurality of pairs of electrodes are disposed on opposite sides of a plurality of ink channels so as to face each other, and in which the electrodes on one side of these pairs are supported by one common support member and are electrically connected to this member. Preferably, these electrodes are worked and formed integrally with this support member. Immediately after a predetermined current has been caused to flow between a selected one of the electrodes in one direction, another current is caused to flow in the opposite direction to prevent occurrence of a trickle of ink at the nozzle end. Each of the electrodes is formed of a nonmagnetic material and the current caused between the electrodes is controlled base on magnetic flux intensities measured with respect to the ink channels. The resistance between at least a selected one of the electrodes is previously detected and the magnitude of current or the current duration time during printing is controlled based on data obtained by this detection. Further, before the printing operation, ink is heated to be made less viscous by causing a current to flow in a direction opposite to that in the printing operation between the selected electrodes.

These and other objects, features and advantages of the present invention will become clear when reference is made to the following description of the preferred embodiments of the present invention together with reference to the accompanying drawings.

DESCRIPTION OF THE PREFERRED EMBODIMENTS

Figure 1:
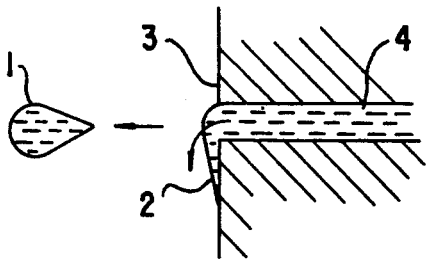
FIG.1 PRIOR ART
FIG. 1 is a schematic cross-section illustrating a trickle of ink occurring at the tip of a nozzle on a conventional Fleming-type ink-jet head.

Various embodiments of the present invention will be explained below with reference to the accompanying drawings. Throughout the figures, the same parts as those in the figures shown previously are given the same reference numerals.

Figure 2:
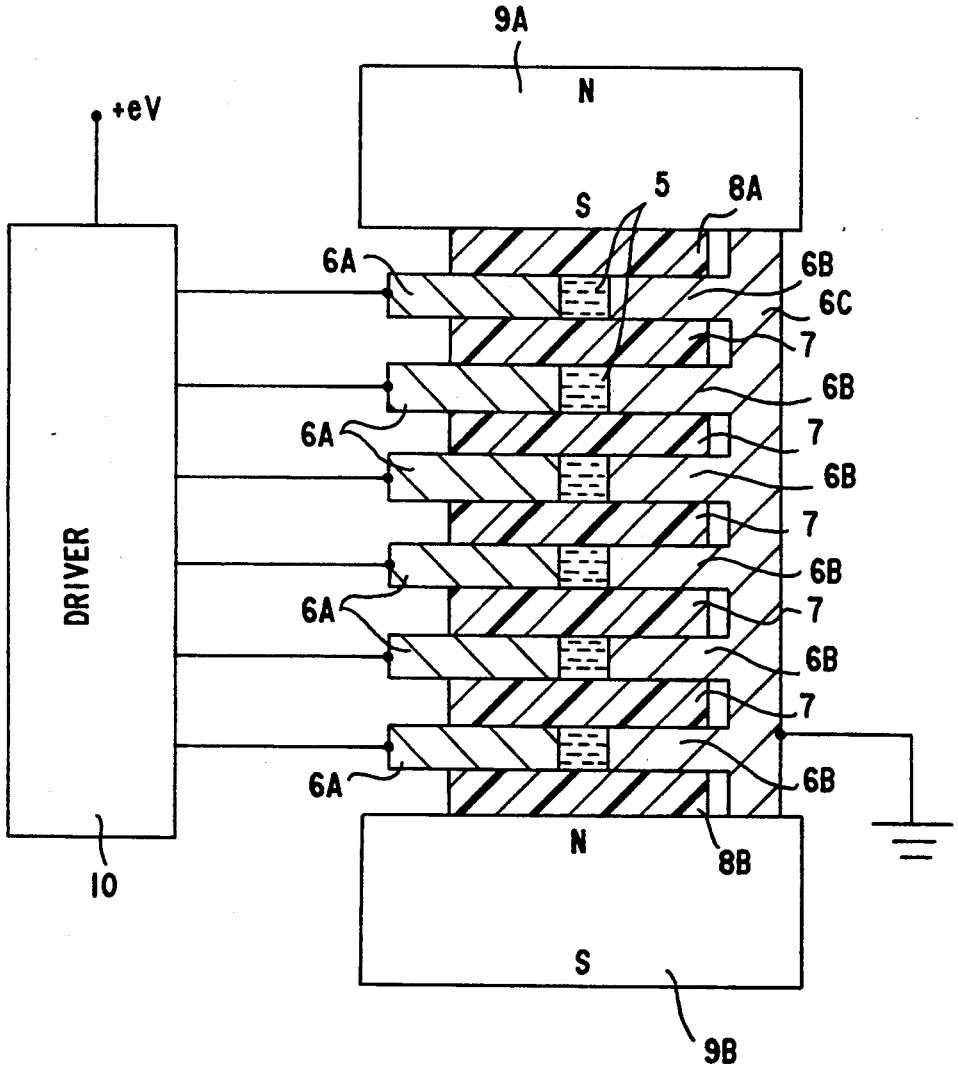
FIG. 2 is a schematic cross-section showing fundamentals of the structure of an ink-jet head according to the present invention.

FIG. 2 schematically shows fundamentals of the structure of an ink-jet head in accordance with a first embodiment of the present invention in a cross-section taken in the vicinity of nozzles perpendicularly to ink channels 5. In FIG. 2 are illustrated five pairs of electrodes 6A and 6B provided on opposite sides of the channels 5. Insulating channel partition plates 7 are provided between the pairs of electrodes 6A and 6B, that is, the partition plates 7 and the pairs of electrodes are alternately disposed. A top cover plate 8A and a bottom cover plate 8B each formed of an insulating material are provided on the uppermost pair of electrodes 6A and 6B and below the lowermost pair of electrodes 6A and 6B, respectively. Magnetic flux generating means 9A and 9B formed of, for example, permanent magnets are disposed between which the stack of the pairs of electrodes 6A and 6B, the partition plates 7 and the top and bottom plates are interposed.

A space surrounded by each pair of electrodes 6A and 6B and two of the plates including the partition plates 7 and the top and bottom plates 8A and 8B in contact with the electrodes 6A and 6B forms one ink channel 5. The magnetic flux generating means 9A and 9B forms a magnetic field which extend across the ink channels 5. A driver circuit 10 causes a pulse current to flow between some of the pairs of electrodes 6A and 6B selected. This current and the magnetic field formed by the magnetic flux generating means 9A and 9B are perpendicular to each other, and a force is generated in the channel 5 corresponding to the selected pair of electrodes 6A and 6B in accordance with Fleming's left-hand rule, in which force has a direction corresponding to the longitudinal direction of the channel 5. Conductive ink in the channel 5 is jetted by this force.

In the conventional Fleming type ink-jet heads, all the pairs of electrodes corresponding to the illustrated electrodes 6A and 6B are formed independently with respect to the channels. In this construction, increases in the number of parts and the manufacturing cost cannot be avoided. Also, soldering for electrical connection and accurate alignment are required for each of the electrodes. For this reason, as well, the assemblage is necessarily complicated and the manufacturing steps are increased. The manufacturing cost is thereby increased and there is a considerably large possibility of a reduction in printing quality or in the reliability of the head.

In accordance with the present invention, all the electrodes 6B, for example, are formed integrally with a common side plate 6C. Alignment of the electrodes 6B therefore depends upon the accuracy with which the electrodes 6B and the side plate 6C are worked and it is, in fact, possible to ensure a high electrode positioning accuracy. Moreover, the electrodes 6B are electrically connected to an external circuit (e.g., the driver circuit 10) at only one point. A reduction in the number of manufacturing steps and an improvement in the reliability of ink-jet heads can therefore be achieved. Instead of this arrangement of forming all the electrodes 6B integrally with the side plate 6C, an arrangement may alternatively be used in which the electrodes 6B are combined into a plurality of groups and each group of electrodes 6B and an electroconductive mating side plate 6C are integrally formed. This arrangement is also advantageous.

Figure 3:
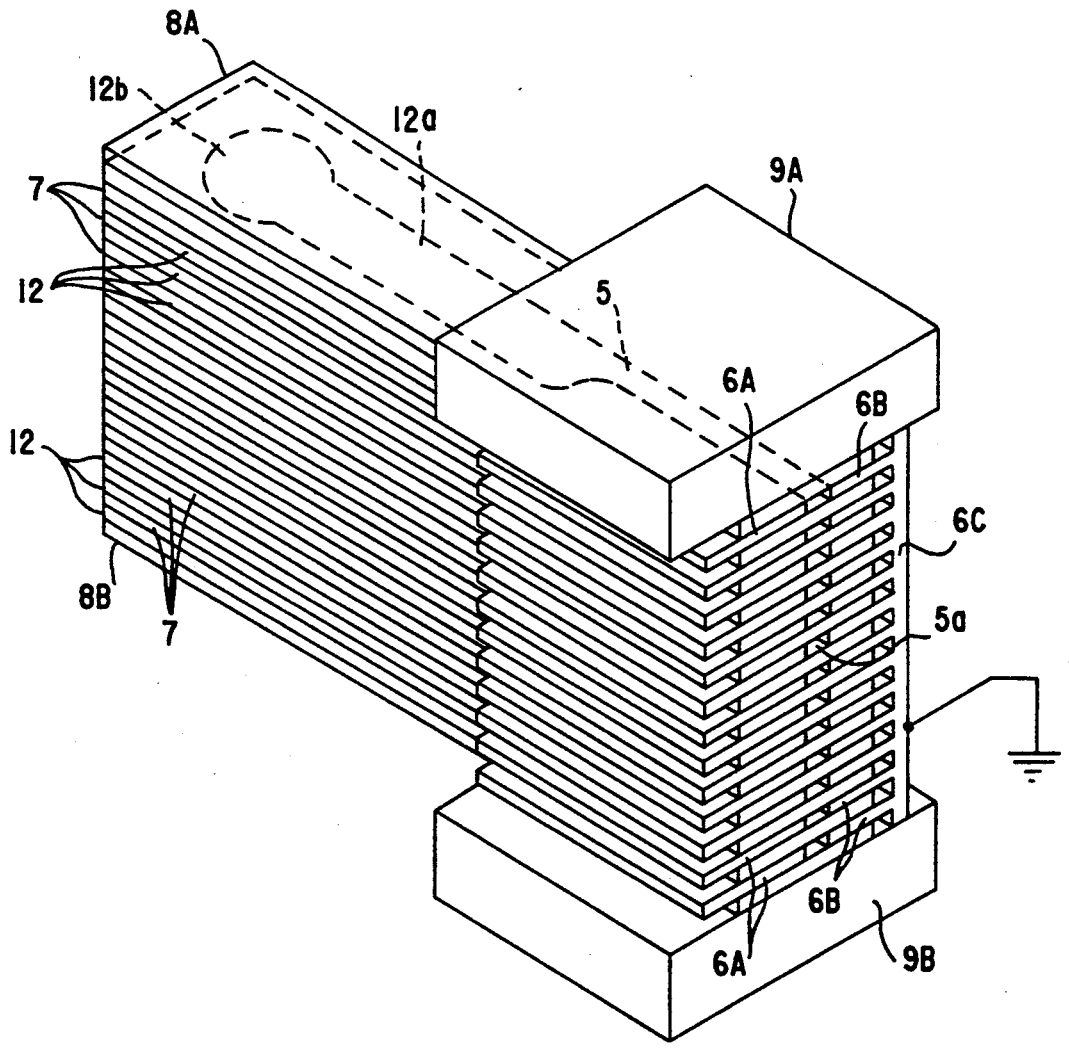
FIG. 3 is a perspective view Of the ink-jet head of the present invention.
Figure 4:
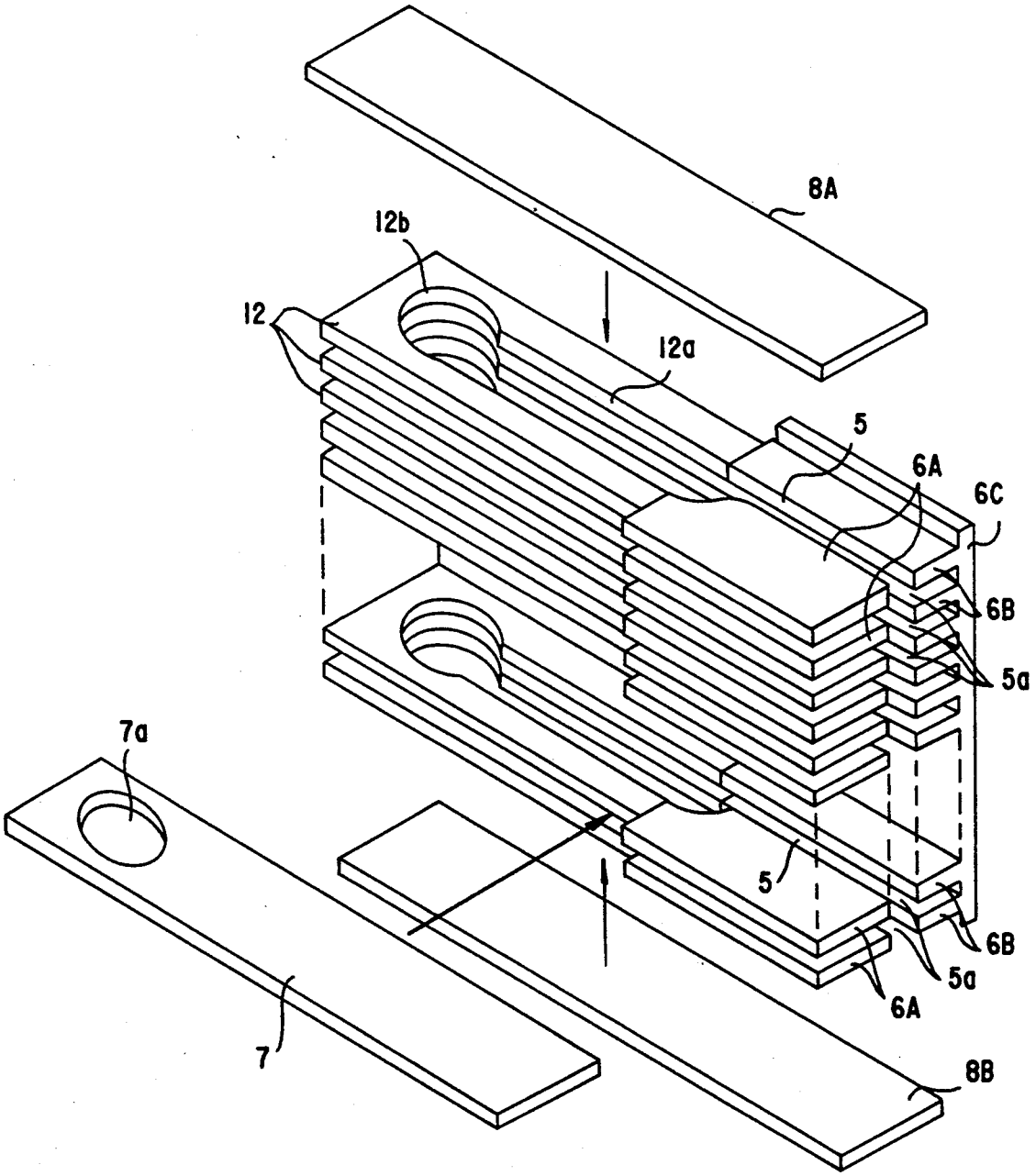
FIG. 4 is an exploded perspective view of the ink-jet head of the present invention.

The structure of the ink-jet head in accordance with the present invention will be described below in more detail with reference to FIGS. 3 and 4.

An insulating plate-like member 12 is mechanically connected to each of the pair of electrodes 6A and 6B one of which is formed integrally with the common side plate 6C. Each plate-like member 12 is formed of, for example, a plastic or a ceramic and is equal in thickness to the electrodes 6A and 6B. The electrodes 6A and 6B are formed of, a nonmagnetic metal such as 17-7 stainless steel such that the loss of the magnetic flux applied to the channels 5 by the permanent magnets 9A and 9B shown in FIG. 2 can be avoided. The pairs of electrodes 6A and 6B and the plate-like members 12 thus formed and the partition plates 7 are alternately superimposed on each other. In FIGS. 3 and 4, the opening end (i.e., the nozzle of one of the channels 5 surrounded by the electrodes 6A and 6B and the partition plates 7) is indicated by reference symbol 5*a*.

Cutouts 12*a* and 12*b* which communicate with the corresponding channel 5 are formed in each plate-like member 12. The cutout 12*a* serves as a reservoir for containing ink to be supplied to the channel 5, and the cutout 12*b* constitutes a common path through which ink is supplied to the ink reservoirs 12*a* formed in the plate-like members 12. That is, the cutouts 12*b* are formed while being aligned with orifices 7*a* formed in the partition plates 7, and the common path is formed when the plate-like members 12 and the partition plates 7 are superposed on each other. Ink is distributed to the ink reservoirs 12*a* through the common path.

The electrodes 6A and 6B and the plate-like members 12 are connected by, for example, using an adhesive. The electrodes 6A and 6B and the side plate 6C may be formed by working or molding an insulating material such as plastics or ceramics into the illustrated shapes of the electrodes 6A and the electrode 6B and the side plate 6C integrally formed and by coating the surfaces of these members with a nonmagnetic metal. Further, a material such as plastic or ceramic may be worked to form each plate-like member 12 integrally with at least a portion corresponding to electrode 6A, and the portion corresponding to the electrode 6A may be coated with a nonmagnetic metal. This structure is advantageous in that the need for a mechanical connection between the electrode 6A and the plate-like member 12 is eliminated.

Figure 5:
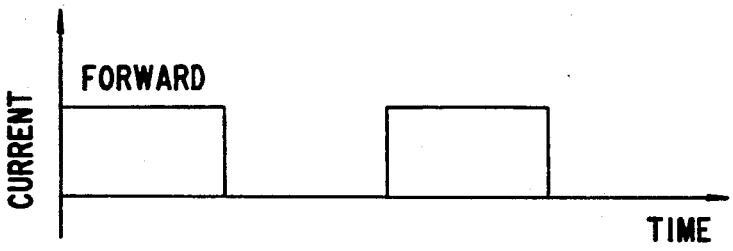
FIG.5 PRIOR ART
FIG. 5 is a graph of current pulses for driving the conventional ink-jet head.

In general, in Fleming-type ink-jet heads, the head is driven by causing a pulse-like current flow through each selected pair of electrodes so that a jetting force is applied to ink. Ordinarily, in conventional methods for driving Fleming type ink-jets heads, no current is caused to flow through the pair of electrodes during pause periods when ink is not ejected, as shown in FIG. 5. Also, no current is caused to flow through non-selected pairs of electrodes. Japanese Laid-Open Patent Application No. 57-83459 discloses a method of causing, immediately before each ejection period, an electric current in the direction opposite to the direction of the current for generating the ink ejecting force (hereinafter referred to as "forward direction").

Conventional driving methods including above cannot prevent a surplus amount of ink not included in a jetted droplet from remaining as a trickle of ink 2, as described above with reference to FIG. 1, which causes a deterioration in printing qualities.

Figure 6:
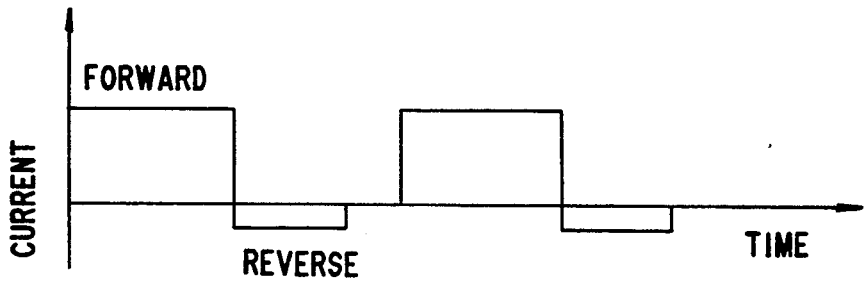
FIG. 6 is a graph of an example of a current pulse train for driving the ink-jet head of the present invention.
Figure 7:
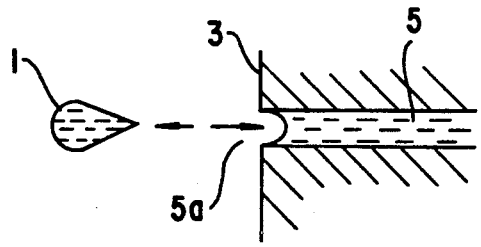
FIG. 7 is a schematic cross-section showing a situation where occurrence of ink trickling is prevented by the driving method of the present invention.

In accordance with the present invention, as shown in FIG. 6, a current is caused to flow in the forward direction between selected one of pairs of electrodes 6A and 6B to eject ink and, immediately after this operation, a current is caused to flow between the electrodes 6A and 6B in the reverse direction. According to this driving method, as shown in FIG. 7, a droplet of ink 1 is jetted through the tip of the nozzle 5*a* by the current in the forward direction, and the current in the reverse direction caused immediately after jetting applies a force to the ink in the channel 5 which draws back the ink. An amount of ink remaining at the tip of the nozzle 5*a* is thereby drawn into the channel 5, thereby preventing occurrence of a trickle of ink 2 such as that experienced in the prior art (FIG. 1).

Figure 8:
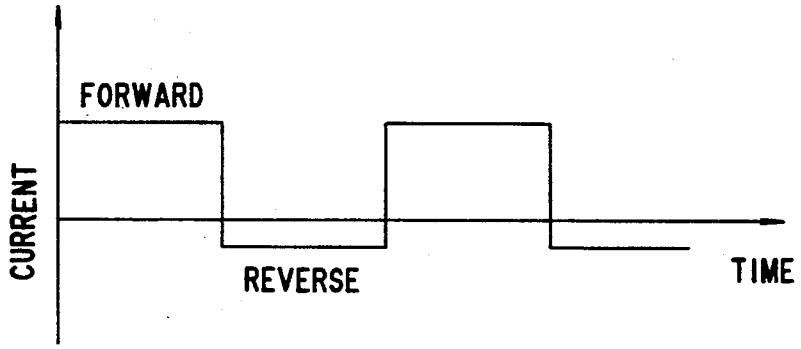
FIG. 8 is a graph of another example of the current pulse train for driving the ink-jet head of the present invention.
Figure 9:
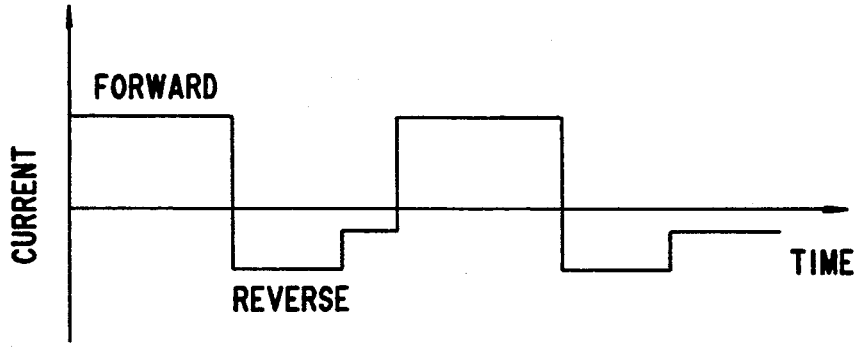
FIG. 9 is a graph of a further example of the current pulse train for driving the ink-jet head of the present invention.

This reverse current may flow constantly through the whole pause period as shown in FIG. 8, or may be set to a large magnitude immediately after the ejection period and thereafter set to a small magnitude, as shown in FIG. 9. The latter method is particularly effective in the case of high-speed printing. That is, in the case of high-speed printing, the time for jetting each ink droplet is short and the inertia of ink flowing through the channel 5 is therefore large. It is possible to check the flow of surplus ink through the nozzle tip 5*a* at the time of high-speed printing by causing a large reverse electric current immediately after the ejection period as shown in FIG. 9. The smaller reverse current thereafter flowing acts to stop an ink flow caused by a constant pressure due to gravity or the like.

If in the Fleming-type ink-jet head the current flowing across each channel 5 and the intensity of magnetic field applied to the channel 5 are not uniform, the size of jetted ink droplets varies, resulting in a deterioration in printing qualities.

The change in the density of ink is also included in the causes of variations in the ink droplet size. That is, the viscosity of an amount of ink staying in the channel 5 of a low selection frequency is increased as the solvent of the ink is evaporated. By this phenomenon, a part of the ink ejection driving force is, of course, cancelled out and small droplets are ejected.

According to the present invention, a means for heating ink is provided to reduce the viscosity. In ink whose viscosity is increased by evaporation of the solvent, the density of electrolytes constituting the ink is increased and the resistance of the ink is thereby changed. It is therefore possible to indirectly ascertain the viscosity by detecting the ink resistance. The electrodes 6A and 6B can be used as means for detecting the resistance for this purpose and as later-described means for heating ink. That is, a predetermined voltage is applied between the electrodes 6A and 6B and the resistance of ink is calculated from the current thereby caused. An electric current controlled based on the resistance calculated is caused between the electrodes 6A and 6B to heat ink so that the viscosity thereof is reduced. Then a predetermined electric current is supplied to eject ink.

Needless to say, in this resistance detection process, the predetermined voltage is set to a level such as to prevent any ink droplet from being ejected through the nozzle 5*a*. Preferably, the current supplied between the electrodes 6A and 6B to heat ink is caused to flow in the reverse direction to avoid ejection of an ink droplet. However, if an electromagnet is used instead of the permanent magnets, if the energization of this electromagnet is controlled to be stopped at least during the period of time for heating ink, the current for heating ink may be caused to flow in either direction.

The causes of variations in the currents flowing across the channels 5 include, as well as the above-mentioned factors relating to the resistance of ink, a structural factor such as non-uniformity of the opposed areas of the electrodes 6A and 6B, and non-uniformity of the resistance of an external circuit (driver circuit 10 shown in FIG. 2). In general, when the current flowing through each channel 5 is small, the ink ejection driving force is also small. The size of a ink droplet is therefore reduced and printing quality thereby deteriorates. To solve this problem, according to one aspect of the present invention, a method is used in which the width or the magnitude of current pulses applied to the pairs of electrodes 6A and 6B is controlled so as to compensate for the non-uniformity of currents flowing between the electrodes 6A and 6B, in other words, apparent non-uniformity of the ink resistance.

Figure 10:
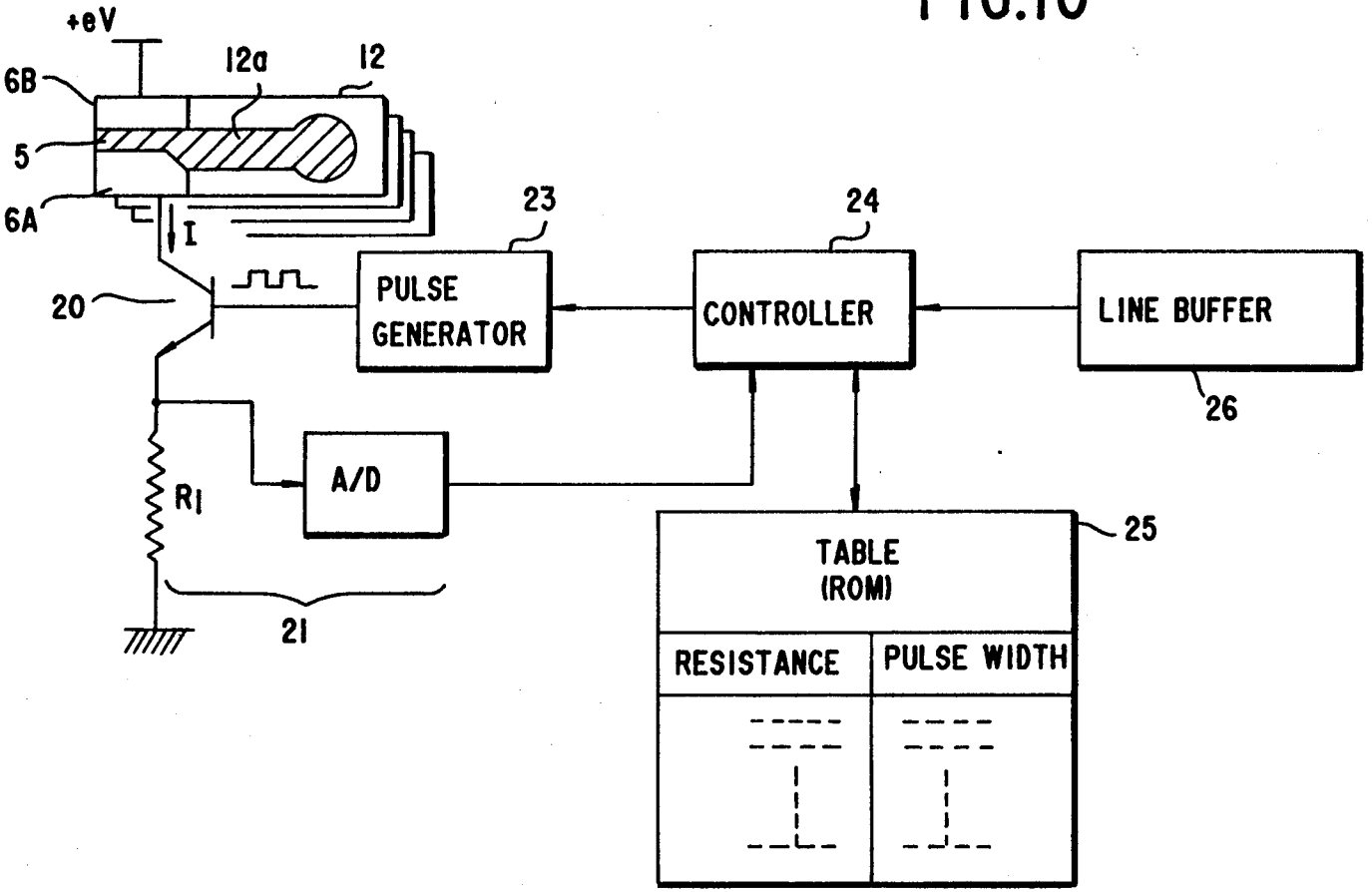
FIG. 10 is a block diagram of an embodiment of the present invention arranged to prevent a deterioration in printing quality due to non-uniformity of the resistances of the electrodes of the Fleming-type ink-jet head.

FIG. 10 is a block diagram of a circuit for controlling the current pulse width for this purpose in accordance with an embodiment of the present invention. In this embodiment, the electrodes 6B in the pairs of electrodes 6A and 6B, which are integrally formed, are not grounded as shown in FIG. 2 but connected to a power supply +eV. A switching means 20 formed of, for example, a bipolar transistor is connected to each of the electrodes 6A which are formed electrically independently. The switching means 20 corresponds to each output driver incorporated in the driver circuit 10 (FIG. 2). In this embodiment, a resistance detection means 21 including a reference resistor ($R_1$) and an analog/digital converter (A/D) is connected to the switching means 20. A pulse signal generator circuit 23 constituting an ink ejection control means together with a controller 24 and a read only memory (ROM) 25 is connected to the gate of the switching means 20 (e.g., the base of a bipolar transistor). A table of correspondence between the resistance values and the current pulse widths is stored in the ROM 25. The operation of the resistance detection means 21 and the ink ejection control means will be described below.

The controller 24 successively selects the pair of electrodes 6A and 6B based on printing data sent from a line buffer 26, and instructs the corresponding pulse signal generator circuit 23 to turn on the switching means 20 for a short time such that printing is not effected, thereby causing a small current through the reference resistor ($R_1$). The voltage generated across the reference resistor ($R_1$) by this current is proportional to the resistance between the electrodes 6A and 6B. The controller 24 refers to the ROM 25 to obtain data on the current pulse width corresponding to the resistance (time for duration of the current supplied to flow between the electrodes 6A and 6B for printing), and sends this data to the pulse signal generator circuit 23. The pulse generator circuit 23 turns on the switching means 20 based on this data. Thus, a current pulse having a width determined according to the resistance between the electrodes 6A and 6B is caused to flow between these electrodes. If the ejection driving force is supplied in the channel 5 for a comparatively long time, a comparatively large droplet of ink is ejected through the corresponding nozzle 5*a*. Thus, the variation in the ink droplet size due to the change in the resistance between the electrodes 6A and 6B can be compensated.

Figure 11:
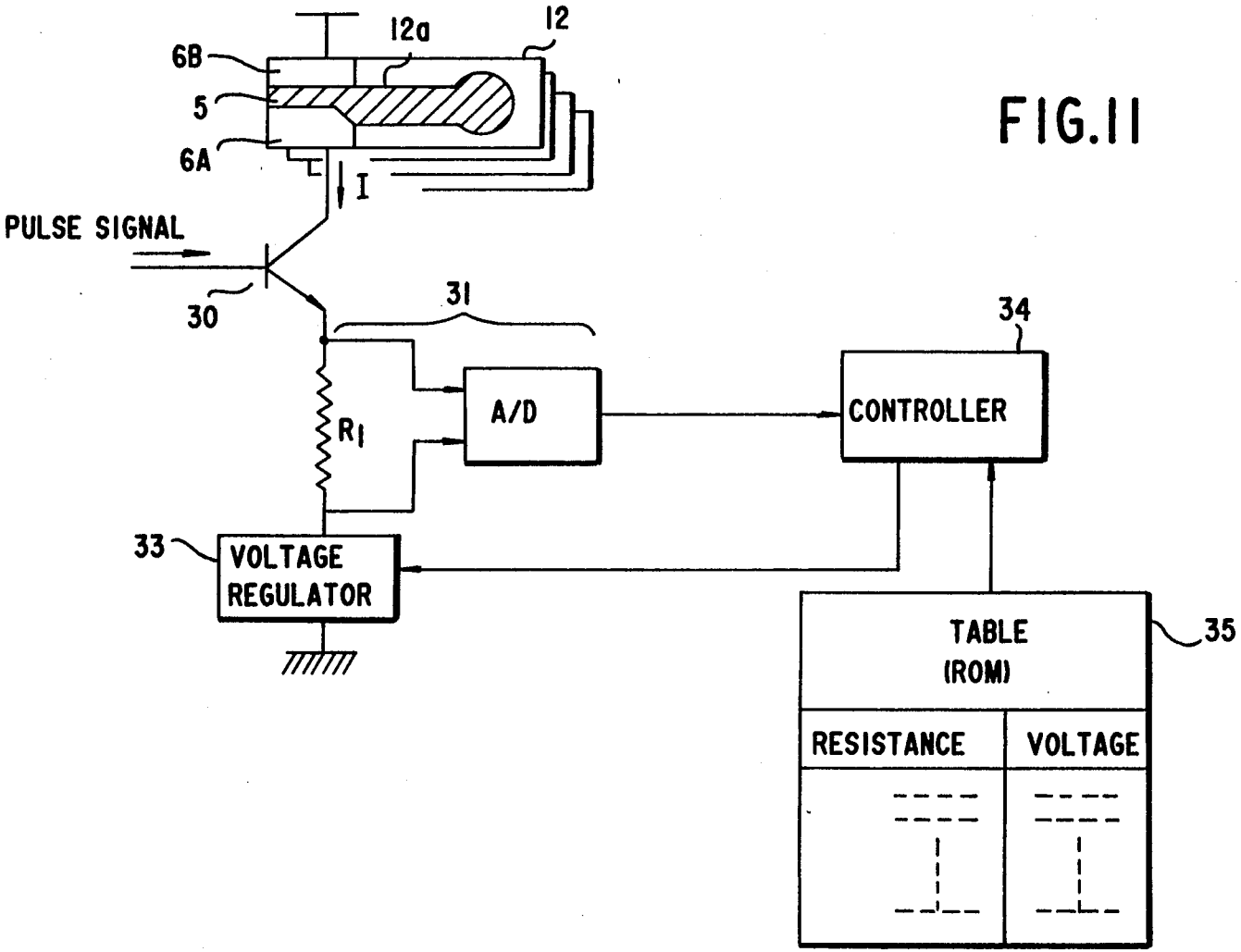
FIG. 11 is a block diagram of another embodiment of the present invention arranged to prevent a deterioration in printing quality due to non-uniformity of the resistances of the electrodes of the Fleming-type ink-jet head.

FIG. 11 is a block diagram of a circuit for controlling the magnitude of the current pulse width in accordance with another embodiment of the present invention. In this embodiment, the electrodes 6B in the pairs of electrodes 6A and 6B, which are integrally formed, are grounded, for example. A switching means 30 formed of, for example, a bipolar transistor is connected to each of the electrodes 6A which are formed electrically independently. The switching means 30 corresponds to each output driver incorporated in the driver circuit 10 (FIG. 2). In this embodiment, a resistance detection means 31 including a reference resistor ($R_1$) and an analog/digital converter (A/D) is connected to the switching means 30. A pulse signal for turning on each switching means 30 at the time of ink ejection or later-described resistance detection is supplied to the gate of the switching means 30 (e.g., the base of a bipolar transistor).

A controller 34 constituting an ink ejection control means together with a ROM 35 is connected to an output end of the resistance detection means 31. A table of correspondence between resistance values and voltages (magnitudes of current pulses) is stored in the ROM 35. A variable voltage regulator 33 whose output voltage is controlled by the controller 34 is connected between the reference register ($R_1$) and the ground. The operation of the resistance detection means 31 and the ink ejection control means will be described below.

To detect the resistance between selected one of the pairs of electrodes 6A and 6B, an instruction pulse signal is supplied to the corresponding switching means 30 so that the switching means 30 is turned on for a shot time such that printing is not effected. At this time, the output voltage of the voltage regulator 33 is controlled to be set to a predetermined level. A small current is thereby caused to flow through the reference resistor ($R_1$). The voltage generated across the reference resistor ($R_1$) by this current is proportional to the resistance between the electrodes 6A and 6B. The controller 34 refers to the ROM 35 to obtain data on the magnitude of current pulse corresponding to the resistance, and controls the output voltage of the voltage regulator 33. Thus, a pulse voltage determined according to the resistance between the electrodes 6A and 6B is applied between these electrodes. The current flowing across each of the channels 5 is controlled to be equal, so that the variation in the ink droplet size due to the change in the resistance between the electrodes 6A and 6B can be compensated.

Figure 12:
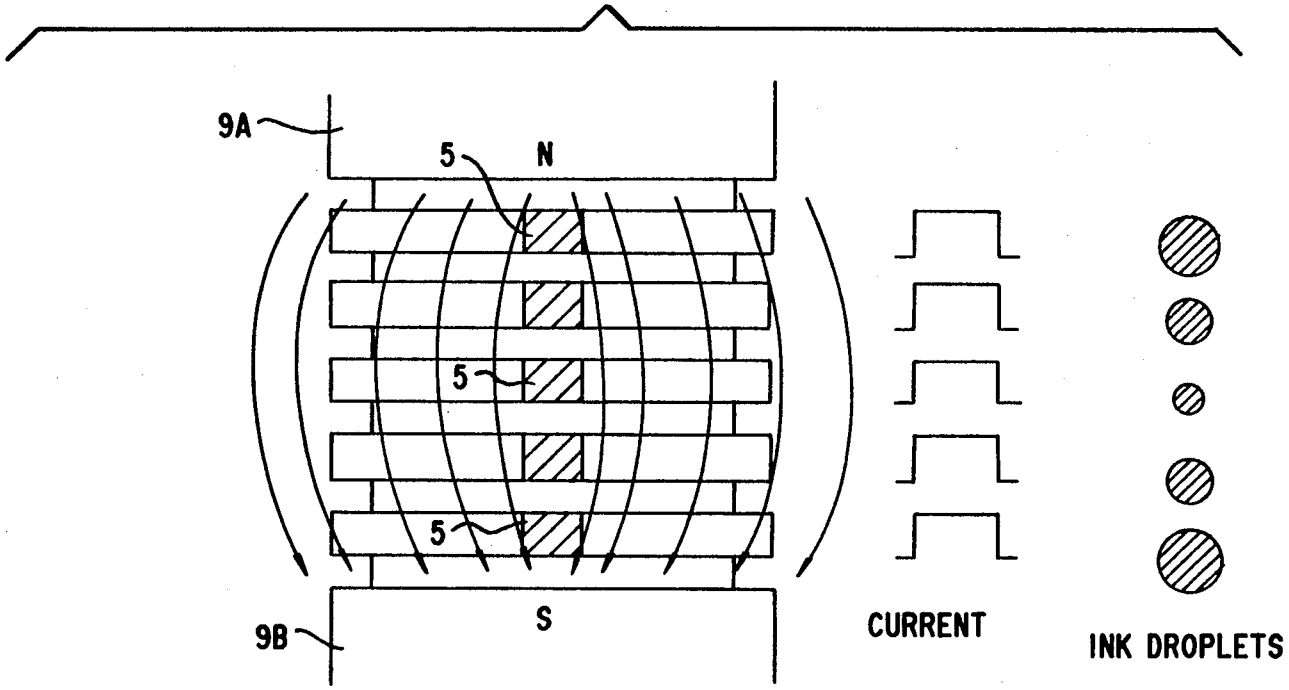
FIG. 12 PRIOR ART
FIG. 12 is a schematic cross-section showing a deterioration in printing qualities due to non-uniformity of the magnetic field of the Fleming-type ink-jet head.

In the Fleming-type ink-jet head, as shown in FIG. 2, a magnetic field is applied by magnets 9A and 9B disposed outside the plurality of stacked channels 5. The magnetic flux diverges to a larger extent at a position closer to the central channel, and the magnetic field becomes correspondingly weaker, as shown in FIG. 12, so that the ejection driving force applied to ink is reduced at a position closer to the central channel 5, resulting in a reduction in the size of ejected ink droplets.

Figure 13:
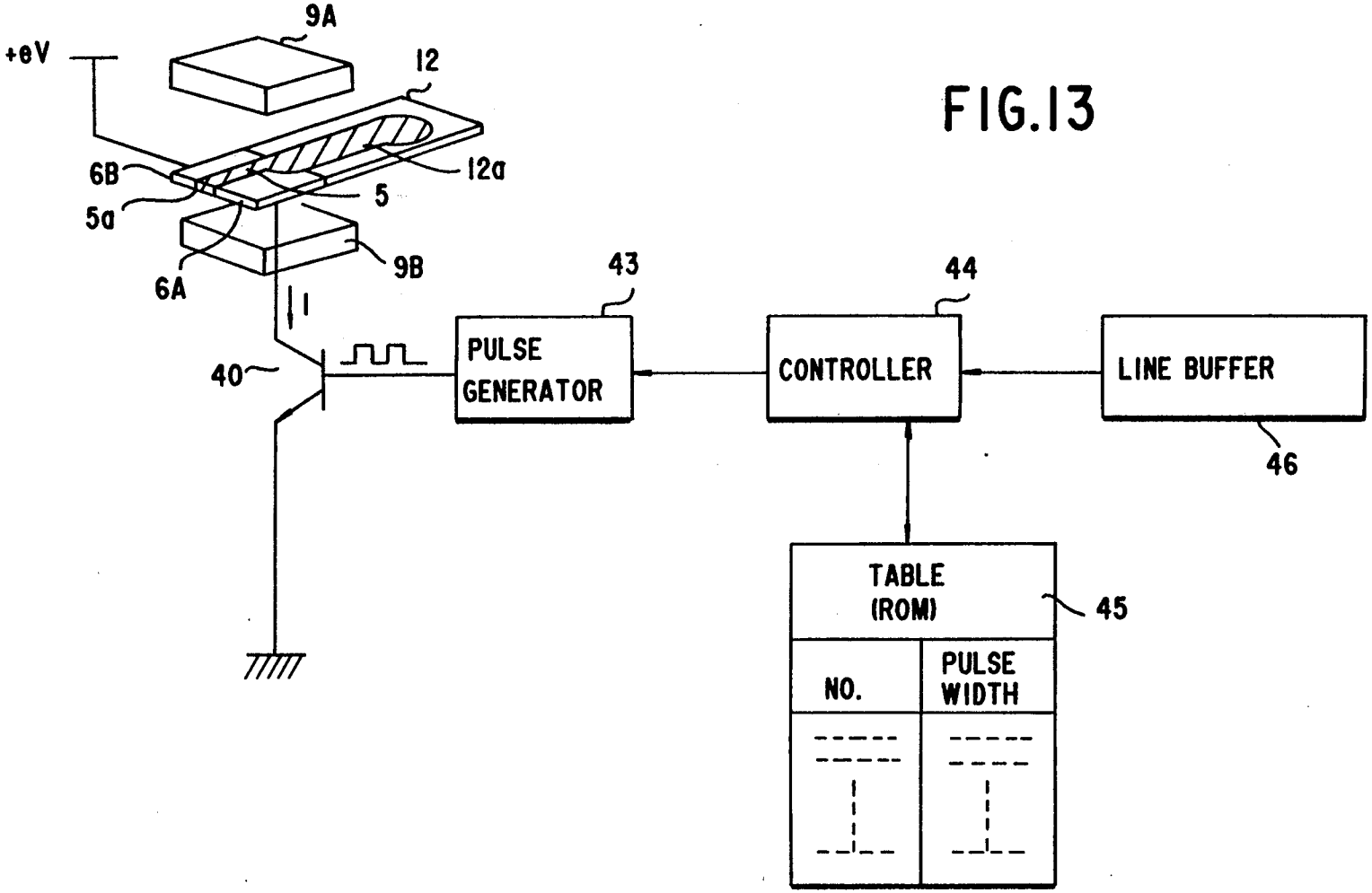
FIG. 13 is a block diagram of an embodiment of the present invention arranged to prevent a deterioration in printing qualities due to non-uniformity of the magnetic field shown in FIG. 12.

In accordance with the present invention, the intensity of the magnetic field is previously measured with respect to the ink channels 5, and the currents flowing across the ink channels 5 are controlled so as to compensate for reductions in the ink ejection driving force due to reductions in the magnetic field. FIG. 13 is a block diagram of an embodiment of the present invention arranged to effect this control, showing, as head components, only one of the pairs of electrodes 6A and 6B and the permanent electromagnets 9A and 9B.

The electrode 6B, which are formed integrally with those of the other pairs, is connected to power supply +eV. A switching means 40 formed of, for example, a bipolar transistor is connected to each of the electrodes 6A which are formed electrically independently. The switching means 40 correspond to output drivers incorporated in the driver circuit 10 (FIG. 2). In this embodiment, a pulse signal generator circuit 43 constituting an ink ejection control means together with a controller 44 and a ROM 45 is connected to the gate of the switching means 40 (e.g., the base of a bipolar transistor). A table of correspondence between numbers indicating the positions of the ink channels 5 and current pulse widths is stored in the ROM 45. The operation of this ink ejection control means will be described below.

The controller 44 successively selects the pair of electrodes 6A and 6B based on printing data sent from a line buffer 46, and refers to the ROM 45 to obtain data on the current pulse width corresponding to the number of the selected pair of electrodes 6A and 6B (time for duration of the current supplied to flow between the electrodes 6A and 6B for printing), and sends this data to the pulse signal generator circuit 43. The pulse generator circuit 43 turns on the switching means 40 based on this data. Thus, a pulse current having a width determined according to the intensity of the magnetic field at the corresponding ink channel 5 is caused to flow between the selected electrodes 6A and 6B. In general, the width of the current pulse is inversely proportional to the intensity of the magnetic field.

In a case where this embodiment is applied to the method of controlling the width or magnitude of current pulse according to the resistance between each pair of electrodes 6A and as described above with reference to FIG. 10 or 11, coefficients for correction of the width or magnitude of current pulse in correspondence with the numbers of the channels 5 may be stored in ROM 25 (FIG. 10) or ROM 35 (FIG. 11). The controller 24 (FIG. 10) or the controller (FIG. 11) may control ejection of ink based on values calculated by multiplying, by the correction coefficients, the width or magnitude of current pulse obtained by referring to the ROM 25 or 35.

Many different embodiments of the present invention may be constructed without departing from the spirit and scope of the present invention.

It should be understood that the present invention is not limited to the specific embodiments described in this specification, and is only limited in the appended claims, wherein what is claimed is:

1. An ink jet head comprising:

a plurality of nozzles opening toward a print surface;

a plurality of channels connected to said plurality of nozzles and filled with an electroconductive ink;

magnetic flux generation means between which a plurality of electrodes are interposed for generating a magnetic fux extending across said plurality of channels;

a plurality of pairs of electrodes, each pair of electrodes disposed so as to face each other on opposite sides of corresponding channels, each of said plurality of pairs of electrodes further being formed so as to generate electric currents across the corresponding channels in a direction perpendicular to the magnetic flux;

current control means for controlling generation of the electric currents between said pairs of electrodes; and a common member connected and formed so as to support at least a portion of said plurality of pairs of electrodes whereby said plurality of pairs of electrodes are electrically connected to said current control means through said common member.

2. An ink jet head according to claim 1, wherein all of said plurality of pairs of electrodes on one side thereof are supported by said common member and electrically connected thereto.

3. An ink jet head according to claim 1, wherein a part of the electrodes of said plurality of pairs of electrodes on one side thereof are supported by said common member and electrically connected thereto.

4. An ink jet head according to claim 1, wherein at least electrodes in a common side of said plurality of pairs of electrodes and said common member are integrally formed from an electroconductive material.

5. An ink jet head according to claim 1, wherein said common member is formed from an insulating plate member, and covered with an electroconductive layer formed thereon.

6. An ink jet head according to claim 1, wherein at least electrodes in a common side of said plurality of pairs of electrodes and said common member are integrally formed from an insulating material, and covered with an electroconductive layer formed thereon.

7. An ink jet head comprising:

a plurality of nozzles opening toward a print surface;

a plurality of channels connected to said plurality of nozzles and filled with an electroconductive ink;

magnetic flux generation means between which a plurality of electrodes are interposed for generating a magnetic flux extending across said plurality of channels;

a plurality of pairs of electrodes, each pair of electrodes disposed so as to face each other on opposite sides of corresponding channels, each of said plurality of pairs of electrodes further being formed so as to generate electric currents across the corresponding channels in a direction perpendicular to the magnetic flux; and current control means for controlling generation of the electric currents between said pairs of electrodes;

each of said pairs of electrodes being formed of a pair of nonmagnetic electroconductive plate-like members, said pairs of electrodes being tacked on each other with insulating plate-like members interposed therebetween so that said pairs of electrodes and said insulating plate-like member are alternately disposed, and each of said plurality of channels being defined by the opposed surfaces of a corresponding pair of electroconductive plate-like members constituting said pairs of electrodes and by surfaces of corresponding insulating plate-like members adjacent thereto.

8. An ink jet head according to claim 7, wherein each of said electroconductive plate-like members is formed of stainless steel.

9. An ink jet head according to claim 1 or 7, wherein said current control means further controls generation of a current to flow between a selected pair of electrodes in a forward direction such that the electroconductive ink is ejected through a corresponding nozzle to effect printing and then, immediately after the printing, in a reverse direction through said selected pair of electrodes.

10. An ink jet head according to claim 9, wherein said current control means further controls generation of a current in the reverse direction during a whole period of time between a completion of printing and a start of a next printing.

11. An ink jet head according to claim 9, wherein said current control means further controls generation of a first current in the reverse direction immediately after printing and of a second current smaller than the first current to flow in the reverse direction between said selected pair of electrodes.

12. An ink jet head according to claim 1 or 7, further comprising: heating means for making the electroconductive ink in said plurality of channels less viscous.

13. An ink jet head according to claim 12, wherein a current is caused to flow in a reverse direction between the electrodes during a printing pause period such that the ink is heated by the reverse directional current and is made less viscous.

14. An ink jet head according to claim 13, wherein an electromagnet is provided as said magnetic flux generation means, and wherein while the operation of said electromagnet is stopped during the printing pause period, a current is caused to flow in the forward direction between the electrodes such that the ink is heated by the forward directional current and is made less viscous.

15. An ink jet head according to claim 1 or 7, further comprising:

resistance detection means for detecting the resistance of at least selected one of said pair of electrodes; and ink ejection control means for controlling the current caused between the selected electrodes to eject the electroconductive ink through corresponding one of said nozzles based on a detection value supplied by said resistance detection means.

16. An ink jet head according to claim 15, wherein said ink ejection control means controls, based on the detection value, the period of time for duration of the current caused between the selected electrodes to eject the electroconductive ink through the corresponding nozzle.

17. An ink jet head according to claim 15, wherein said ink ejection control means controls, based on the detection value, the voltage applied between the selected electrodes to cause the current between the selected electrodes to eject the electroconductive ink through the corresponding nozzle.

18. An ink jet head according to claim 1 or 7, further comprising ink ejection control means for controlling the current caused between each of said pairs of electrodes to eject the electroconductive ink through corresponding one of said nozzles based on the magnitude of the magnetic field generated at corresponding one of said channels by said magnetic flux generation means.

19. An ink jet head according to claim 18, wherein said ink ejection control means controls the period of time for duration of the current caused between the selected electrodes to eject the electroconductive ink through the corresponding nozzle based on the magnitude of the magnetic field.

20. An ink jet head according to claim 18, wherein said ink ejection control means controls the voltage applied between the selected electrodes to cause the current between the selected electrodes to eject the electroconductive ink through the corresponding nozzle based on the magnitude of the magnetic field.

* * * * *